United States Patent [19]

Mailliet et al.

[11] Patent Number: 4,533,125

[45] Date of Patent: Aug. 6, 1985

[54] APPARATUS FOR GUIDING AND CHANGING IMMERSION LANCES

[75] Inventors: Pierre Mailliet, Howald; Radomir Andonov, Mamer; Hubert Stomp, Howald; Jean Monai, Petange, all of Luxembourg

[73] Assignee: Paul Wurth S.A., Luxembourg, Luxembourg

[21] Appl. No.: 563,630

[22] Filed: Dec. 20, 1983

[30] Foreign Application Priority Data

Dec. 21, 1982 [LU] Luxembourg ..... 84543
Jun. 29, 1983 [LU] Luxembourg ..... 84884

[51] Int. Cl.[3] ..... C21C 5/30
[52] U.S. Cl. ..... 266/226
[58] Field of Search ..... 266/226

[56] References Cited

U.S. PATENT DOCUMENTS 2,472,416 7/1949 Gibson ..... 266/34
3,480,267 11/1969 Gregord ..... 266/226
4,097,031 6/1978 Higuchi ..... 266/226
4,139,185 2/1979 Henryson ..... 266/226
4,431,170 2/1984 Hummler ..... 266/226
4,441,701 4/1984 Beentjes ..... 266/226

*Primary Examiner*—Peter D. Rosenberg
*Attorney, Agent, or Firm*—Fishman & Dionne

[57] ABSTRACT

A lance guiding and changing apparatus is presented for immersion lances which enables the lances to be changed or replaced at a rapid rate, the lances being held particularly firmly and rigidly during the plural injection processes. The immersion lance guiding and changing apparatus comprises, in part, lance storage means, lance transfer means, and lance changing means. The lance changing means includes a vertical mount which is capable of rotating about its vertical axis via a suitable drive means. At least two lance carriages are suspended on the mount, and the carriages are vertically transportable along the mount. The lance storage means, preferably comprised of a turret-type container capable of holding a plurality of lances, supplies or receives new and used lances respectively. The lance transfer means transfers the new or used lances between the storage means and the rotatable mount.

37 Claims, 28 Drawing Figures

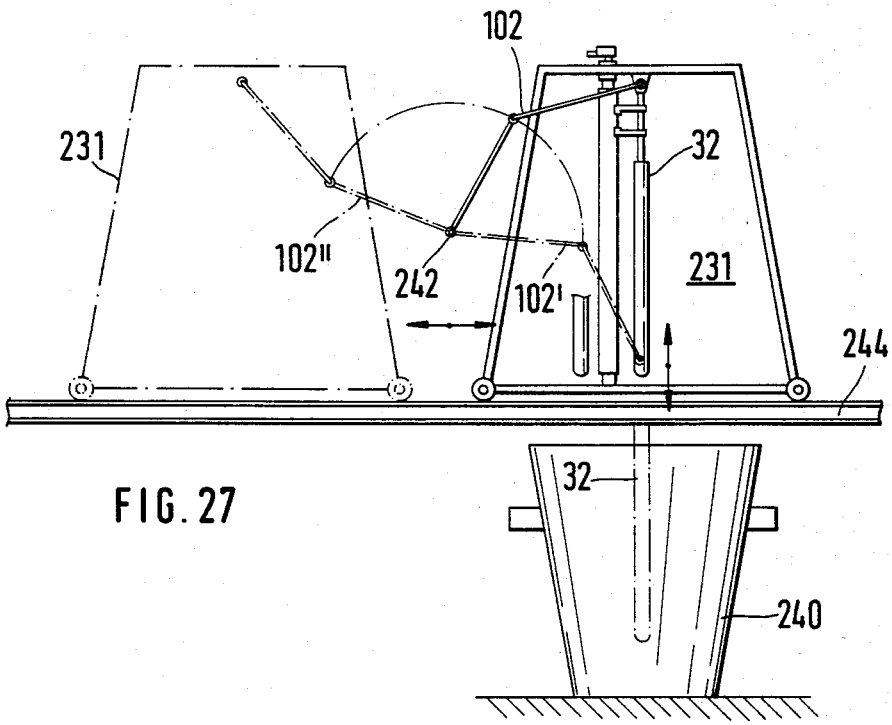
FIG. 27
FIG. 28
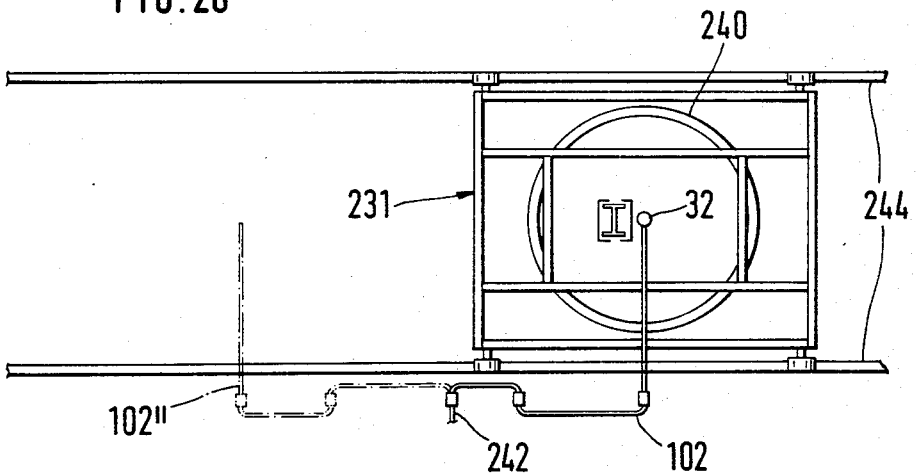

APPARATUS FOR GUIDING AND CHANGING IMMERSION LANCES

BACKGROUND OF THE INVENTION

This invention relates to the field of metal refining. More particularly, this invention relates to an apparatus for guiding and replacing lances, particularly those lances intended for immersion into a metal melt.

Over the past few decades, processes have been developed wherein iron melts are desulphurized by the addition of materials which are capable of forming compounds with the sulphur in the melt at high temperatures and under certain reducing conditions. These additive materials are pulverized into granular form and are introduced into the melt in suitably proportioned quantities by means of an immersion lance and a carrier gas, preferably argon.

A process similar to the above and an associated apparatus for the desulphurization of iron melts is described in European patent application No. 0 013 550, which is incorporated herein by reference. Moreover, a new type of apparatus for the introduction of immersion lances into the melt is described in European patent applications Nos. 0 056 942 and 0 056 944, which are incorporated herein by reference.

Unfortunately, these well known types of desulphurization apparatii exhibit a number of problems and difficulties which have thus far not been satisfactorily resolved. One such problem is that the immersion lance should be held as rigidly as possible during the material injection process so that no undesirable or harmful vibrations occur within the apparatus. A second problem is that, until now, it has not been possible to replace the lances as rapidly as desired, thereby resulting in less efficient and slower treatments for successive iron melts within the vessel or ladle.

A further deficiency of the prior art methods and apparatus for the desulphurization of iron melts is that the operation of automatically connecting the blowing lance to the gas supply head has necessitated the providing of movable electrical leads or pneumatic or hydraulic pipes for the supply of energy to the coupling mechanism.

SUMMARY OF THE INVENTION

The above discussed and other problems of the prior art are overcome or alleviated by the immersion lance guiding and changing apparatus of the present invention. In accordance with the present invention, a novel immersion lance guiding and changing apparatus is provided which enables the blowing lances to be changed or replaced at a rapid rate, the lances being held particularly firmly and rigidly during the plural injection processes. Moreover, no movable leads to the coupling mechanism are required for the connection of the lance to the gas supply head.

The immersion lance guiding and changing apparatus comprises, in part, lance storage means, lance transfer means, and lance changing means. The lance changing means includes a vertical mount which is capable of rotating about its vertical axis via a suitable drive means. At least two lance carriages are suspended on the mount. These carriages are vertically transportable along the mount and are preferably comprised of bifurcated suspension devices which are capable of holding immersion lances. A gas supply head means, preferably having jointed piping or conduits associated therewith provides communication between an immersion lance and a supply system. The lance storage means, preferably comprised of a turret-type container capable of holding a plurality of lances, supplies or receives new and used lances respectively. The lance transfer means, preferably including a lance conveyor carriage having a bifurcated rocking lever, transfers the new or used lances between the storage means and the rotatable mount of the lance changing means.

The above discussed and other advantages of the present invention will be apparent to and understood by those skilled in the art from the following detailed description and drawings.

BRIEF DESCRIPTION OF THE DRAWINGS

Referring now to the drawings, wherein like elements are numbered alike in the several FIGURES:

FIG. 27 is a schematic side elevation view of a transportable lance changing apparatus in accordance with the present invention.

FIG. 28 is a schematic plan view of the transportable lance changing apparatus of FIG. 27.

DESCRIPTION OF THE PREFERRED EMBODIMENT

Figure 1:
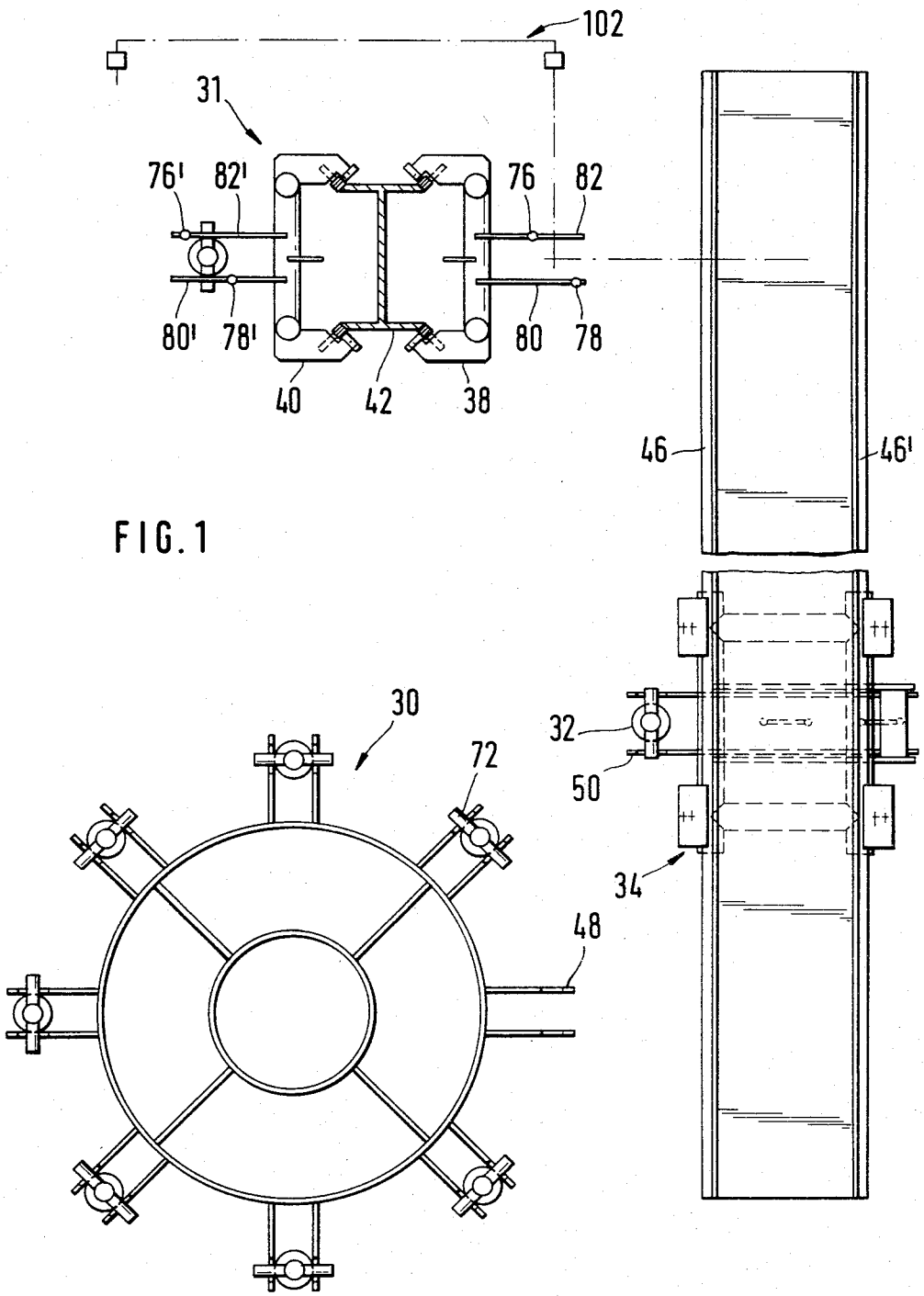
FIG. 1 is a plan view lance storage, lance transfer and changing apparatus, in accordance with the present invention.

Referring first to FIG. 1, an overall system of the apparatus of the present invention is shown. The system includes a storage container 30 for storing the lances; a lance changing apparatus 31; and a lance conveyor carriage 34 by which used and new lances can be conveyed back and forth between the storage container 30 and the lance changing apparatus 31.

In the first embodiment of the present invention shown in FIG. 1, the storage container 30 is a turret-type holder capable of rotating about a vertical axis. Such a holder is well known in the art and is described in European ptent aplication No. EP-A-O 056 942 which is assigned to the assignee hereof and incorporated herein by reference. It will be understood that as soon as a storage container 30 of this type has been filled with used lances, it will be replaced by one having fresh lances thereon.

Figure 2:
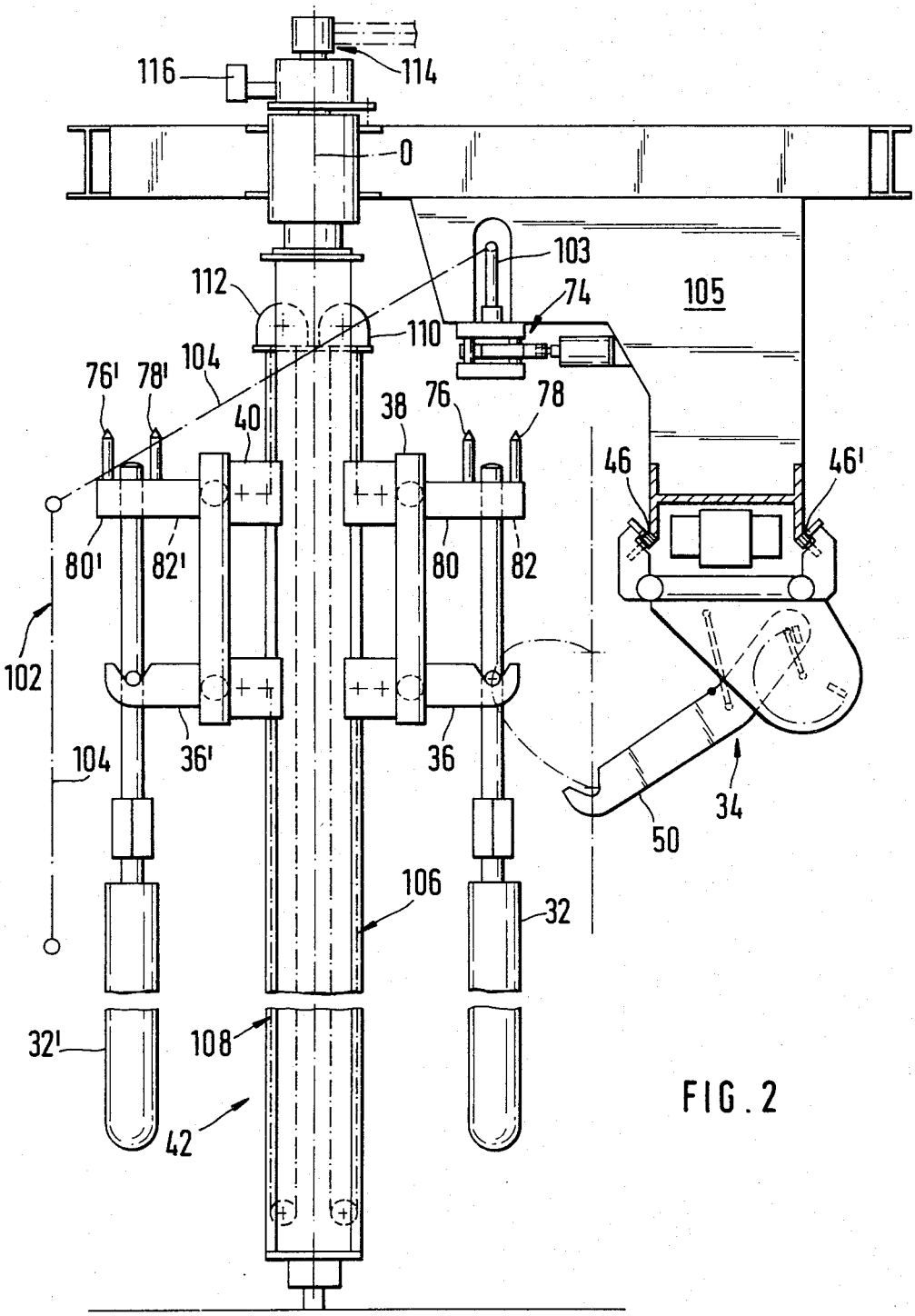
FIG. 2 is a side elevation view of a lance changing apparatus and a lance conveyor carriage in accordance with the present invention.

FIG. 1 also shows an empty lance suspension 48. A lance 32 which had been in suspension 48 is now suspended from the lance conveyor carriage 34. Assuming, that this lance 32 has not yet been utilized in a refining process, the carriage 34, movable along the rails 46 and 46′ will now be moved into the position shown in FIG. 2 opposite the lance carriage 38 of the lance changing apparatus 31. As shown in FIG. 2, the lance conveyor carriage 34 is suspended by means of rollers from the rails 46 and 46′, the rails being formed as part of an H girder.

The lance changing apparatus 31 of the present invention has a vertical double mount 42 which is capable of rotating about a vertical axis 0. The mount 42 has a number of lance carriages 38 and 40 mounted thereon in such a way as to be movable in the vertical direction.

In FIG. 2, two identical lance carriages 38 and 40 are mounted opposite each other on the double mount 42. Each of the two lance carriage 38 and 40 including respectively, two horizontal arms 80, 82 and 80′, 82′ (see also FIG. 1) and a lance suspension system 36, 36′. The two lance carriages 38 and 40 may be vertically moved along the mount 42 by means of two chain drives 106 and 108 driven, respectively, by pneumatic motors 110, 112. Alternatively, instead of two lance carriages 38, 40 it is also possible to have four lance carriages which are arranged in a crosswise fashion and suspended from the mount. The compressed air for the pneumatic motors 110, 112 is preferably supplied via rotary connections 114 on the top of mount 42, the connections 114 being pivotable about the vertical axis 0. Rotary movement of the mount 42 serves to interchange the positions of the two lances 32, 32′. This rotary motion may, for example, be effected by means of a pneumatic motor 116 or pneumatic tandem drives as will be described in greater detail hereinafter.

Figure 3:
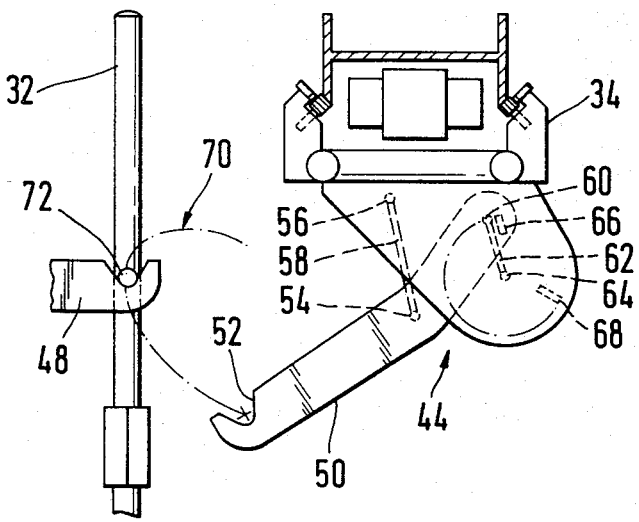
FIG. 3 is a side elevation view showing the first phase in the reception of a lance by the swivel arm of a lance transfer device in accordance with the present invention.
Figure 4:
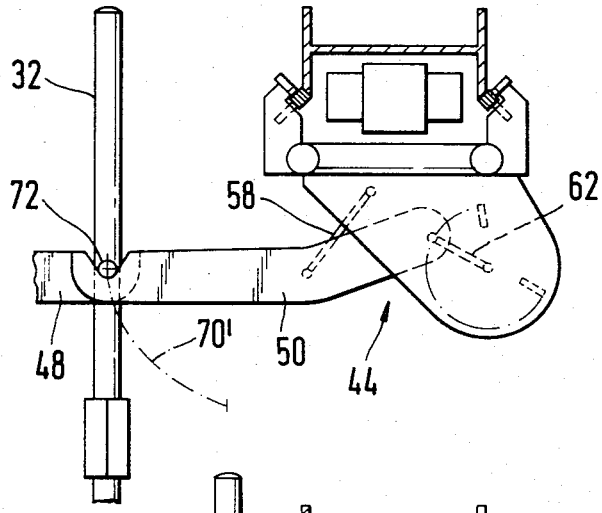
FIG. 4 is a second phase in the lance reception operation of FIG. 3.
Figure 5:
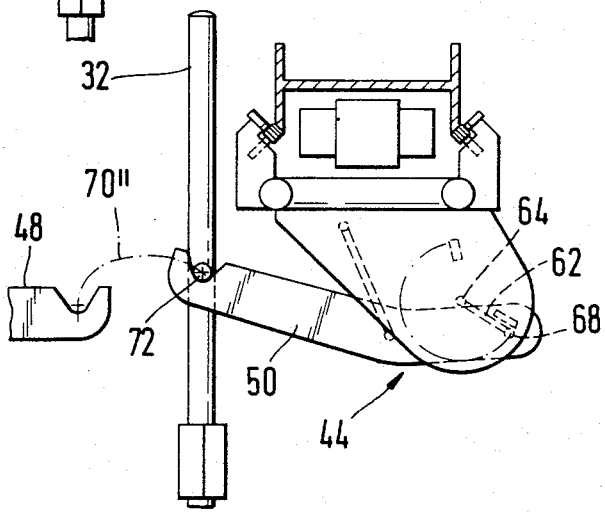
FIG. 5 is a third phase in the lance reception operation of FIG. 3.

The transfer of the lances 32 from the lance conveyor carriage 34 to the lance suspension 36 or storage or container suspension 48 and vice versa, is effected by means of a lance transfer mechanism 44 which is described in more detail below with reference to FIGS. 3, 4 and 5. It will be understood that transfer mechanism 44 is part of the lance conveyor structure 34 of FIGS. 1 and 2. FIGS. 3–5 show the process of the lance conveyor carriage 34 receiving a new lance from a storage container suspension 48 by means of the lance transfer mechanism 44 via three subsequent steps or phases. As may be seen in FIGS. 1, 2 and 3, the lances 32 are suspended in the bifurcated container suspension 48 by means of cross shaped trunnions 72. Lance transfer mechanism 44 has a bifurcated rocking lever 50 with two mutually aligned notches 52 capable of receiving and holding the trunnions 72.

The rocking lever 50 is mounted on the lance conveyor carriage 34 at two rotatable or pivotable suspension points 54 and 60. The first suspension point 54 is located on a suspension strap 58 which, in turn, is pivotable about a fixed point 56 on the carriage 34. The second suspension point 60 is located at the end of a rotatable arm 62 which is mounted on a rotatable shaft 64. Shaft 64 acts as the driving shaft for the pivotal movement of the lever 50. The rotating arm 62 may be rotated by the shaft 64 between the two stops 66 and 68. The rocking lever 50 undergoes a combined rotary and translatory movement whereby, as a result of the particular construction of the suspension and rotation system for lever 50, the end of the lever 50 is movable along the curve 70 as shown in the dotted and dashed line in FIG. 3.

There are many features and advantages of the above described suspension and drive system for lever 50. For example, when the rocking lever 50 is empty (i.e., bearing no load) and is moved into the position shown in FIG. 4, the angle of rotation about the shaft 64 is relatively small. However, when the rocking lever 50 holds the loan of the entire lance thereon, the difference in height which must be covered in order to lift the lance out of the suspension system 48 (corresponding to the trajectory 70″ and the change of position from FIG. 4 to that shown in FIG. 5) is very small, therefore requiring a correspondingly small driving power for the shaft 64. However, while the trajectory 70″ is small, the path covered in the horizontal direction is nevertheless long enough so as to be certain of releasing the lance in the proper direction. Moreover, a further advantage of the suspension and drive system for the rocking lever 50 of the present invention is that when the lance is suspended from the lever 50 in the position shown in FIG. 5, (i.e., when the rotating arm 62 is resting against the stop 68), the lever will self-lock against the stop 68 due to the effect of the lances' own weight when the shaft 64 is free (i.e., not under power). This is particularly important when viewed from a safety standpoint, in the possible event of failure of the driving motor (not shown) of the shaft 64.

After the lance 32 has been lifted and taken up by the lever 50 from storage container 30, the conveyor carriage 34 is moved into the position shown in FIG. 2 relative to the lance carriage 38, so that the lance 32 may be delivered thereto. The delivery of the lance 32 to the suspension system 36 will take place in a manner similar to the operation discussed earlier in regards to FIG. 3-5 (although the rocking lever will be driven in the opposite direction).

Figure 6:
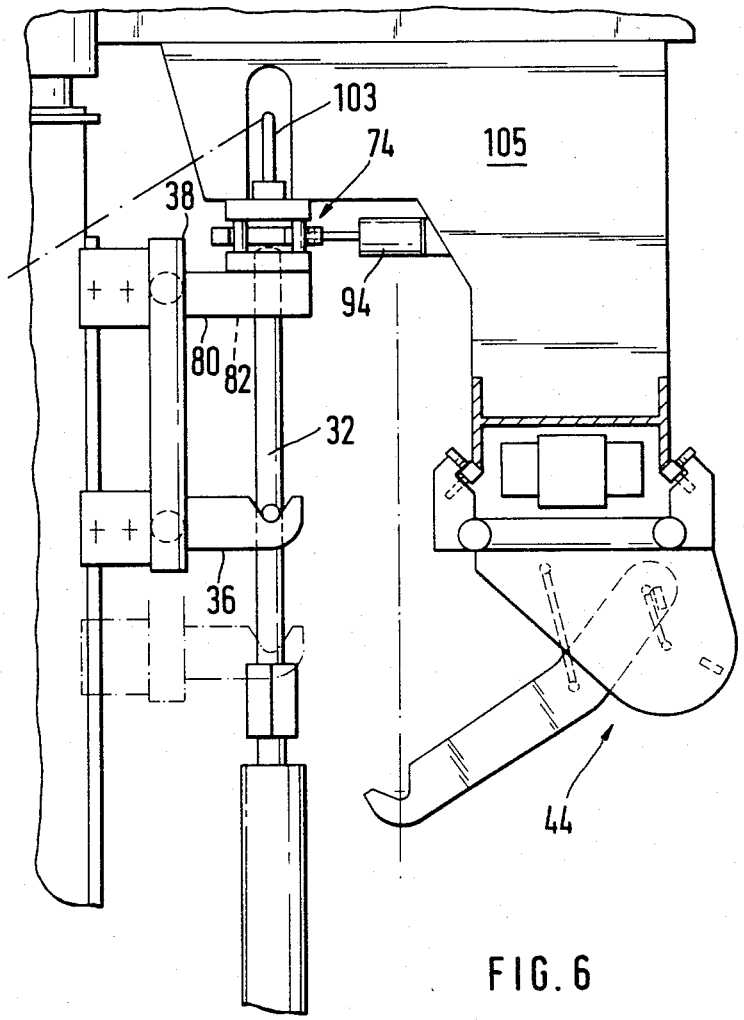
FIG. 6 is a side elevation view showing the operation of coupling the lance to the gas supply head in accordance with the present invention.

The lance carriage 38 with the lance 32 suspended thereon is then moved upward by means of the chain drive 106, from the position shown in the dotted and dashed lines of FIG. 6 to that position shown by the full lines. From this position, the lance may be connected to a supply conduit 102 (see FIGS. 1 and 2) which supplies the treatment materials which are to be injected into the metal melt after immersion of the lance 32 therein. The supply system 102 preferably consists of articulated piping or conduit which is comprised of lengths or segments of rigid pipes 104 interconnected by articulated joints. Supply system 102 is connected to the lance by means of a connecting socket 103 and a gas supply head 74 as shown in FIG. 2.

Figure 7:
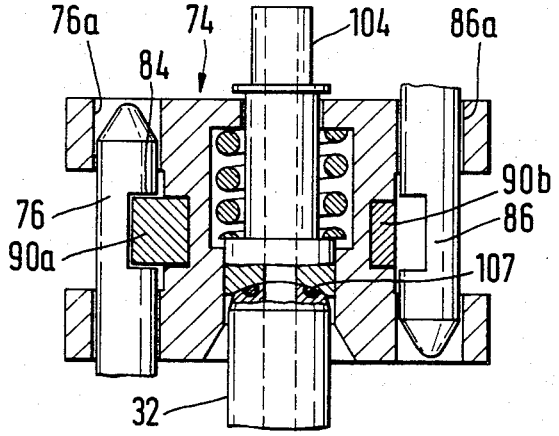
FIG. 7 is a cross sectional elevation view of a gas supply head and coupling mechanism in accordance with the present invention.
Figure 10:
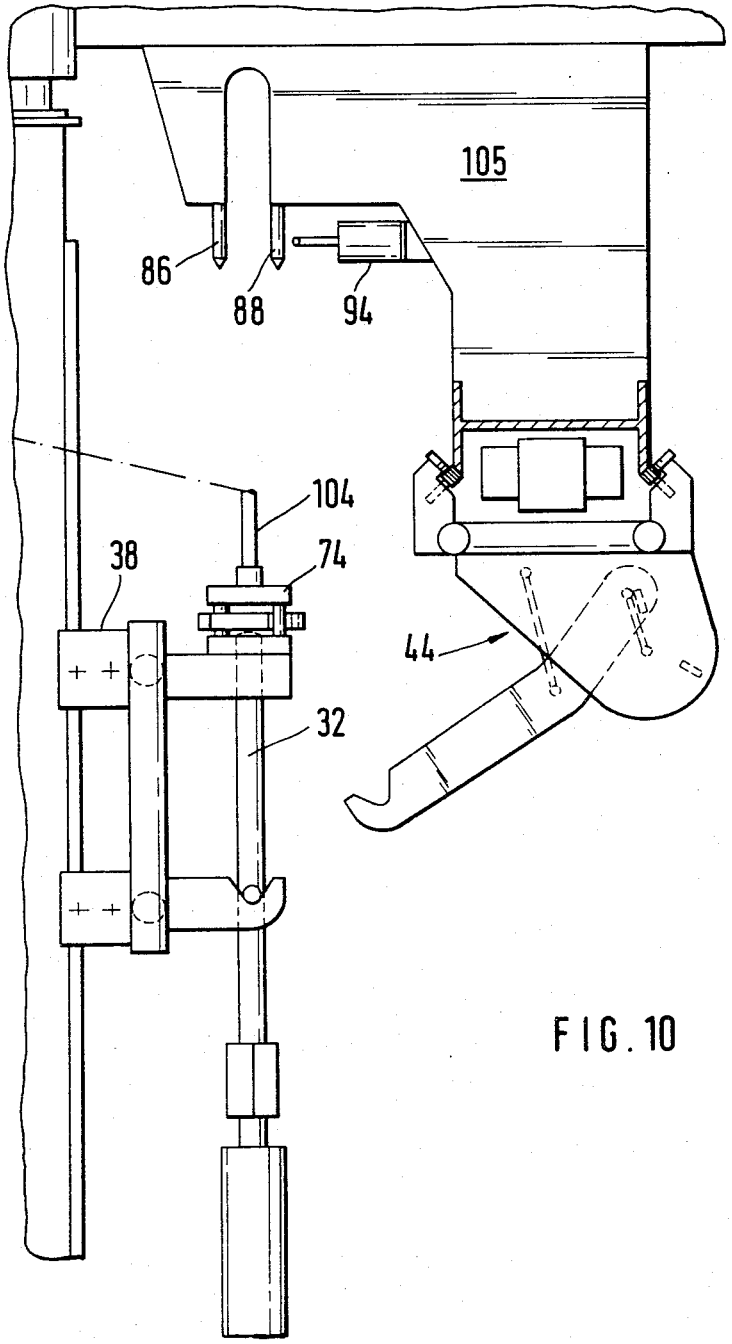
FIG. 10 is a side elevation view showing the lowering of a lance, together with the gas supply head, towards the metal melt in accordance with the present invention.

The gas supply head 74 is shown in a sectional view in FIG. 7 and is well known in the prior art (see European patent application No. EP-A-O 056 942 which is assigned to the assignee hereof and incorporated herein by reference thereto). In accordance with the present invention however, this gas supply head 74 may be constructed so that it can either be connected integrally or hermetically to the lance 32 via a fixed drive together with the connecting socket 104, thus being vertically movable with the lance as shown in FIG. 10; or alternatively, the supply head 74 may be secured to a fixed frame 105 above the lance carriage 38 as shown in FIG. 2.

Figure 8:
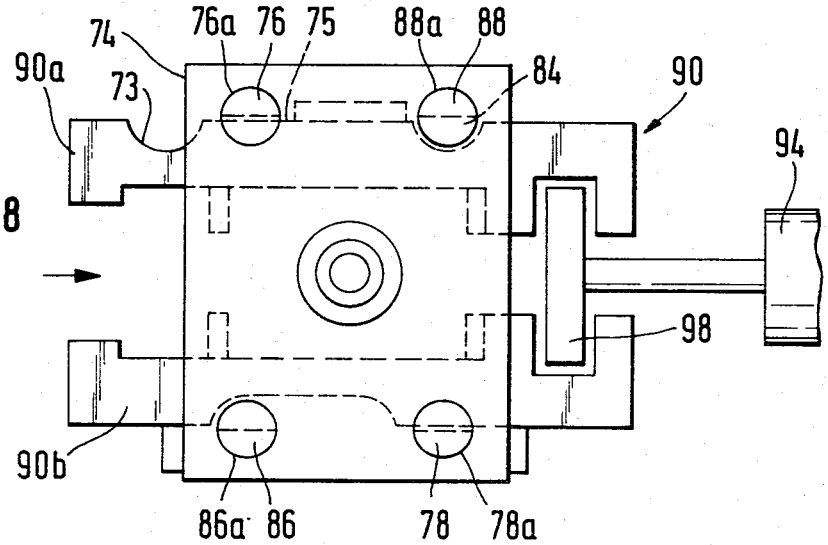
FIG. 8 is a plan view of a first embodiment of the coupling mechanism.

When the gas supply head 74 is secured to a fixed frame 105 as in FIG. 2, the arms 80, 82 and 80', 82' of lance carriages 38 and 40 are provided with two vertical lance carriage pins 76, 78 and 76', 78'. These pins 76, 78 and 76', 78' are positioned in a staggered arrangement relative to each other as shown in FIG. 1. The frame 105 has provided therein two vertical fixed pins 86 and 88 which are located diagonally opposite the pins 76 and 78 respectively. The gas supply head 74, in turn, is provided with four vertical recesses 76*a*, 78*a*, 86*a*, and 88*a* as shown in FIG. 8. These recesses are arranged so that when a lance carriage 38 or 40 (with a lance thereon) and frame 105 are in the position shown in FIG. 6, the recesses 76*a*, 78*a*, 86*a* and 88*a* contain the corresponding lance carriage pins 76, 78 and the fixed pins 86, 88 respectively. Each of the four pins 76, 78, 86 and 88 has a partial rectangular recess 84 through which the gas supply head 74 can be interlocked either with the fixed pins 86, 88 or with the lance carriage pins 76, 78 as desired (see FIGS. 7 and 8).

The interlocking of the gas supply head 74 to one pair of pins 76, 78 or to the other pair of pins 86, 88 is effected by means of a slide bolt 90 similar to a bayonet connection and as shown in FIG. 8. Slide bolt 90 has two parallel bolt segments 90*a* and 90*b* which are horizontally movable through the gas supply head 74 at the level of the recesses 84 of the pins. The slide bolt 90 is also provided with recesses 73 and edges 75 on both segments 90*a* and 90*b*. These recesses 73 and edges 75 are arranged such that they will engage or interlock with one pair of two pins located diagonally opposite each other at the recess 84 by means of the edges 75 and release the other pair of two pins by means of the recesses 73, depending upon the position of the slide 90. Note that in FIG. 8, the fixed pins 86, 88 are released or free while the pins 76, 78 are connected to the gas supply heads 74 via the bolt 90.

As shown in FIG. 8, the bolt 90 is operated by means of a pneumatic cylinder 94 which is fixed in a position so that the plunger 98 will engage the space between the bolt segments 90*a* and 90*b* of slide bolt 90 in the gas supply head 74, without impeding the vertical movements of the gas supply head 74.

Figure 9:
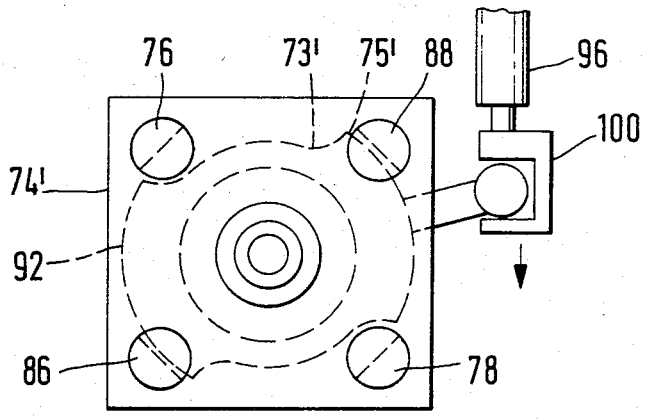
FIG. 9 is a plan view of a second embodiment of the coupling mechanism.

FIG. 9 illustrates another embodiment of a bayonet connection between the gas supply head, identified at 74', and the pins 76, 78 or the pins 86,88. In this embodiment, the connection is provided via a rotatable slide 92, also having recesses 73' and edges 75' as in the slide 90 in FIG. 8. The interaction between the recesses 73' and edges 75' and the incisions 84 on the pins 76, 78, 86 and 88 will either release the one pair of diagonally opposite pins or lock them into position in the gas supply head 74', depending on the angular position of the slide 92. The slide 92 is operated by a fixed but pivotably mounted pneumatic cylinder 96 having a transfer plunger 100 which rotates the slide 92 in the direction shown by the arrow, but does not impede the vertical movements of the gas supply head 74'.

Referring now to FIG. 6, after the gas supply head 74 has been released (by actuating the cylinder 94 or 96) from the fixed pins 86, 88 to which it is initially connected, and interlocked with the lance carriage pins 76, 78 (this locking position shown in FIG. 8), the lance 32 together with the gas supply head 74 and the connecting sockets 104 can then be lowered and the lance immersed in the metal bath (not shown) as in FIG. 10. The lowering of the carriage 38 having the lance 32 mounted thereon is effected by the chain drive 106. Referring to FIG. 7, a sealing device 107 located in the gas supply head 74 acts to insure the necessary hermetic connection between the connecting socket 104 and the calotte-shaped upper end of the lance 32. During this vertical movement of the lance 32, the articulated joint connections of the rigid pipes 104 ensures a continuous connection between the pipe 102 and the lance 32. Accordingly, an important advantage in the present invention is the elimination of the need for suspended flexible conduits which have heretofore been required and have always constituted a danger. A further advantage of the present invention is that the operation of connecting the lance 32 to the supply pipe 102 is completely automated, this connection being effected by means of a driving device 94 or 96 which is fixed in position.

Figure 11:
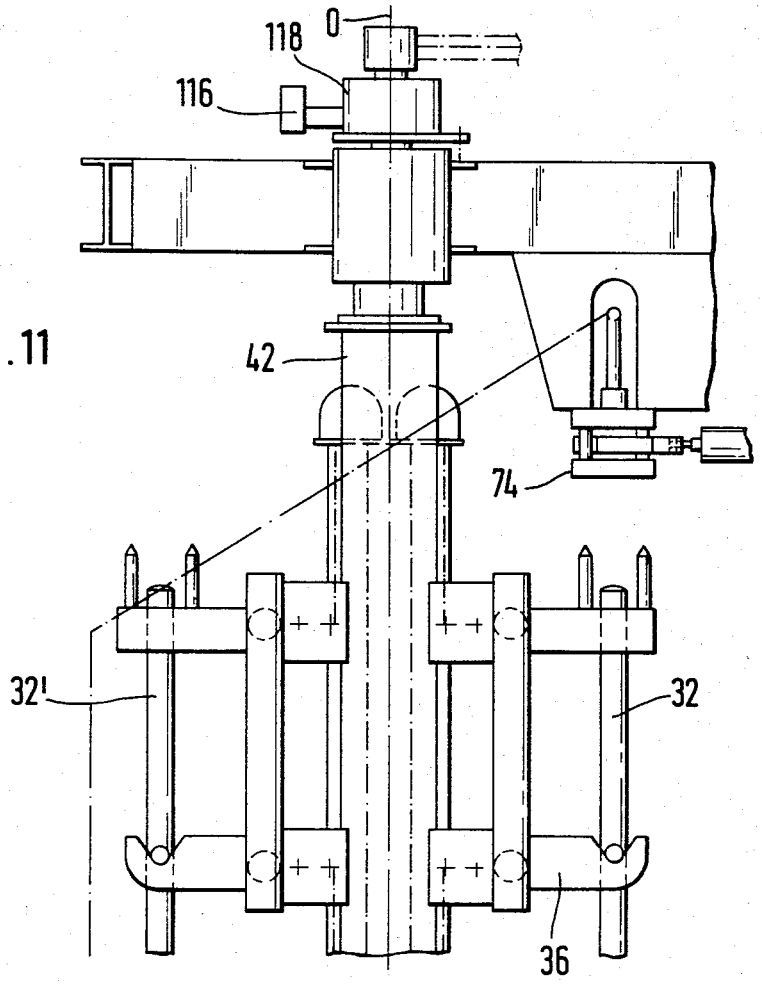
FIG. 11 is a side elevation view showing the rotation of the vertical mount in accordance with the present invention.
Figure 12:
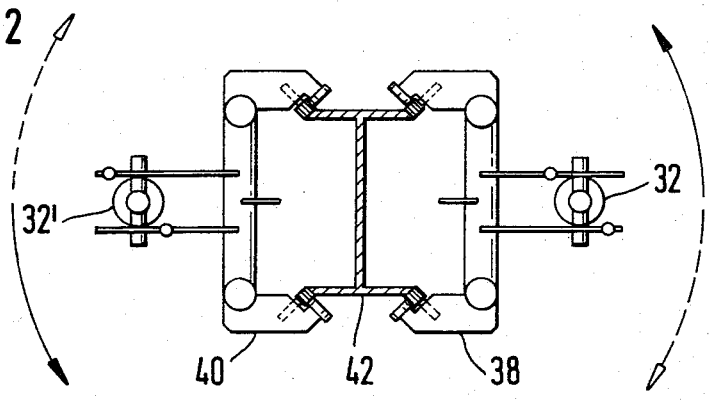
FIG. 12 is a plan view showing the rotation of the vertical mount in FIG. 11 in accordance with the present invention.

Referring now to FIGS. 11 and 12, a first method for removing a used lance 32 and replacing it with a new lance 32' is shown. During this process, the lance 32 is removed by means of the lance conveyor carriage 34 and transferred or conveyed to the lance storage container 30 (shown in FIG. 1). By pivoting the double mount 42 by 180° about its vertical axis 0, the new lance 32' which has been previously mounted on its suspension device 36' may be moved into the position formerly held by the lance 32, i.e., into the operating position prior to its connection to the gas supply head 74 and for immersion into the steel bath. Meanwhile, the lance conveyor carriage 34 will deliver a fresh lance from the container 30 and suspend it in the vacated lance suspension device 36. The fresh lance is mounted onto the suspension device 36' in the time period between two successive injection operations of the active lance, during which time the active lance is withdrawn from the melt, mount 42 is rotated 180° to place empty suspension 36' into position in front of carriage 34 to receive the new lance, the new lance is placed into suspension 36', and the mount 42 is again rotated to place the active lance back in its operating position.

Under those conditions where sufficient space is available, a second lance changing method and apparatus can be utilized in which the gas supply head 74 is not located on the same side of the double mount 42 as the lance conveyor carriage 34, but instead is on the opposite side, i.e., above the lance 32' of FIGS. 2 and 11. In this case, the lance in the position of lance 32' is always the operating lance, and the lance at 32 is the first replacement. As a result, the lance changing process of the present invention is even simpler since the operation of suspending a new lance into the lance holding device 36 will no longer require the second temporary pivoting of the double mount 42 into position in front of the carriage. That is, when a lance is to be changed, one 180° pivoting of mount 42 will position the fresh lance at 32' and the used lance at 32; and the used lance is then removed to the storage 30 and replaced by a fresh lance from storage 30.

FIG. 11 shows the operation of pivoting the double mount 42 about the vertical axis 0 carried out by a pneumatic motor 116 and a gearing 118. In FIGS. 13–16, however, there is illustrated a particularly advantageous embodiment wherein the pivoting is effected by means of two pneumatic cylinders operating in tandem, each cylinder causing a rotation through an angle of exactly 90°.

Figure 15:
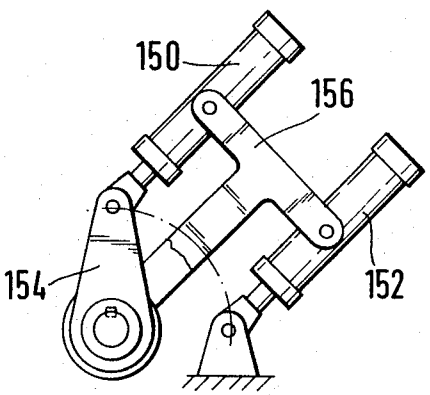
FIG. 15 is a side elevation view showing a drive for the rotation of the mount of FIG. 11 at a third angle.
Figure 14:
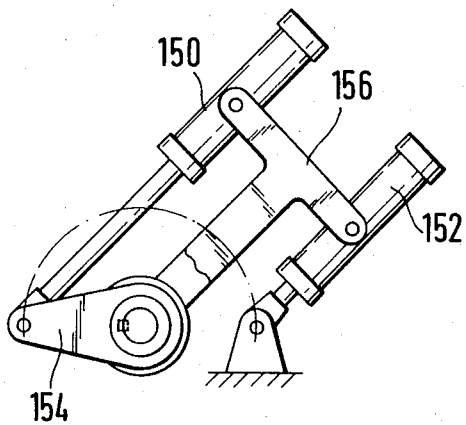
FIG. 14 is a side elevation view showing a drive for the rotation of the mount of FIG. 11 at a second angle.
Figure 16:
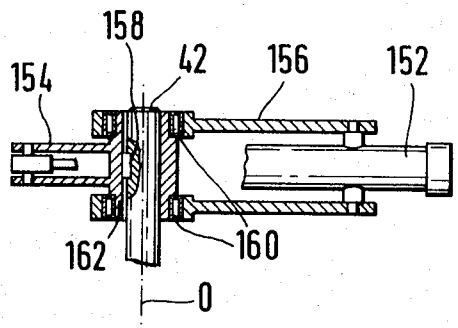
FIG. 16 is a cross sectional elevation view of the drive in the angular position shown in FIG. 14.
Figure 13:
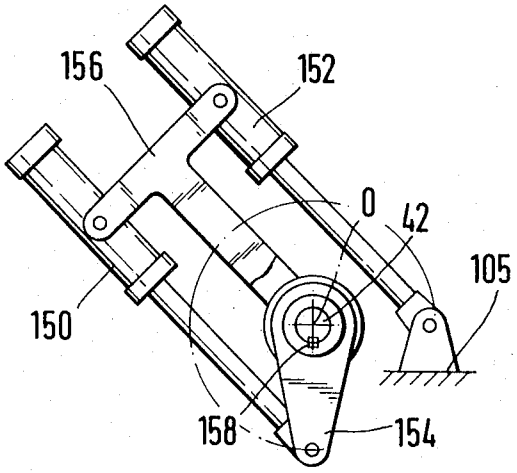
FIG. 13 is a side elevation view showing a drive for the rotation of the mount of FIG. 11 at a first angle.

In FIGS. 13–15, a first cylinder 150 is connected by its piston rod to a rocking lever 154 which is rigidly keyed at 158 to mount 42 in order to pivot the double mount 42. A second pneumatic cylinder 152 is mounted parallel to the first cylinder 150 and is pivotably connected to the fixed frame 105 by its piston rod. The two cylinders 150 and 152 are interconnected by a T-shaped yoke 156. The central bar of yoke 156 is also rotatably mounted via a roller bearing 160 on a central bushing 162, the bushing 162 being rigidly connected to the rocking lever 154 as shown in FIG. 16. As seen in FIG. 16, both the yoke 156 and the rocking lever 154 have a double or bifurcated configuration and so are positioned on both sides of the cylinders 150 and 152.

Figure 17:
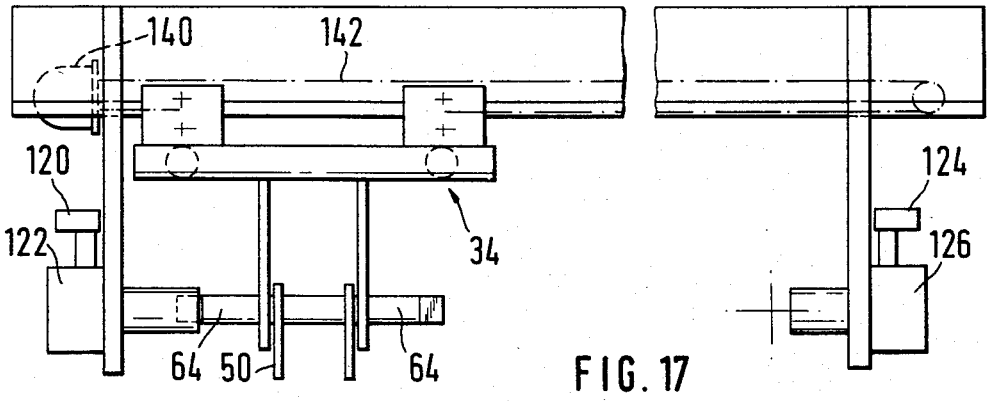
FIG. 17 is a side elevation view showing the operation of the swivel arm of the lance conveyor carriage in a first embodiment having two fixed motors.
Figure 18:
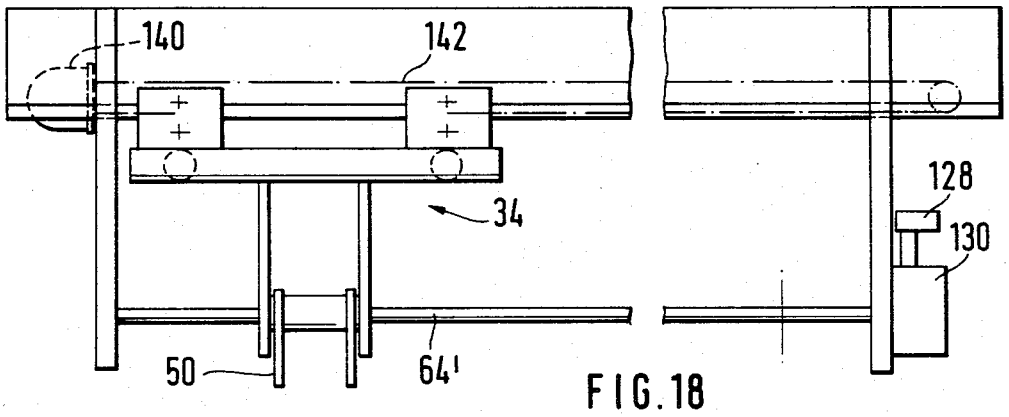
FIG. 18 is a side elevation view showing the operation of the swivel arm of the lance conveyor carriage in a second embodiment having a fixed motor and a spline shaft.
Figure 19:
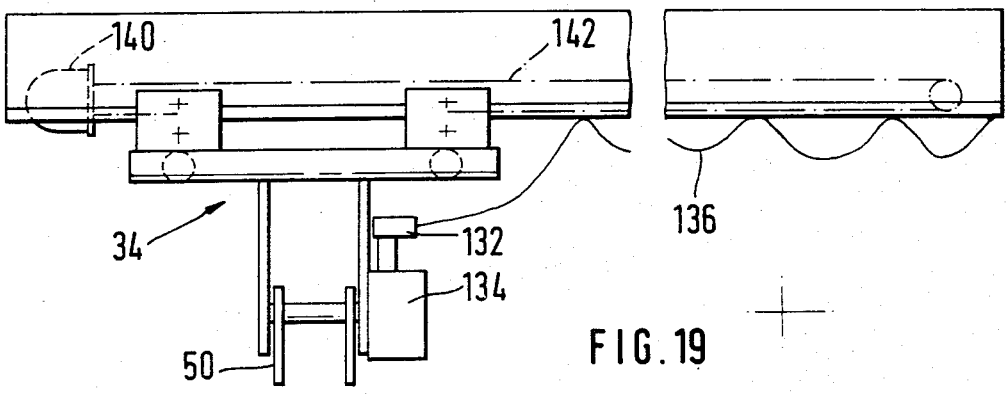
FIG. 19 is a side elevation view showing the operation of the swivel arm of the lance conveyor carriage in a third embodiment having a motor affixed to the carriage.

The method for operating the structure of FIGS. 13–15 can be understood from a consideration of FIGS. 13–15. Starting from the position of FIG. 13, when the piston rod of cylinder 152 is operated to enter the cylinder 152, cylinder 152 is pivoted through an angle of 90° about the point at which it is hinged to the frame 105. The yoke 156 causes the cylinder 150 to follow in this movement; however, the cylinder 150 will remain inoperative, i.e., its piston rod will remain extended. Thus, the entire structure assumes the FIG. 14 position wherein the piston rod of piston 150 has rotated the rocking lever 154 into the position shown in FIG. 14 whereby the double mount 42 will be rotated through an angle of 90°. Next, piston 150 is operated to draw in its piston rod, whereby an additional rotation of 90° of lever 154 and mount 42 will occur, the position of the cylinder 152 of the yoke remaining unaltered. Thus, the structure will assume the position of FIG. 15. It will be understood that the sequence of operations shown in FIGS. 13–15 may similarly be reversed, i.e., the cylinder 150 can be actuated first and the cylinder 152 can be actuated thereafter. FIGS. 17, 18 and 19 show several different methods of driving the rocking lever 50 of the lance conveyor carriage 34. In the embodiment of FIG. 17, use is made of the fact that the lever 50 is only operated when the carriage 34 occupies one of its two end positions. For this reason, driving motors 120 and 124 with gearings 122 and 126 respectively thereon, are provided in the two end positions whereby they are automatically coupled to the shaft 64 of the rocking lever mechanism at each end of travel of carriage 34.

In the embodiment of FIG. 18, there is only one motor 128 having a gearing 130 thereon. In this case, the shaft 64' corresponding to the shaft 64 will run along the entire path of the carriage 34. As a consequence thereof, shaft 64' is constructed as a spline shaft similar to the well known draw spindles on turning machines.

In the embodiment of FIG. 19, a motor 132 with gearings 134 is mounted directly on the carriage 34. Accordingly, the energy is supplied to the motor 132 through flexible leads 136.

Figure 20:
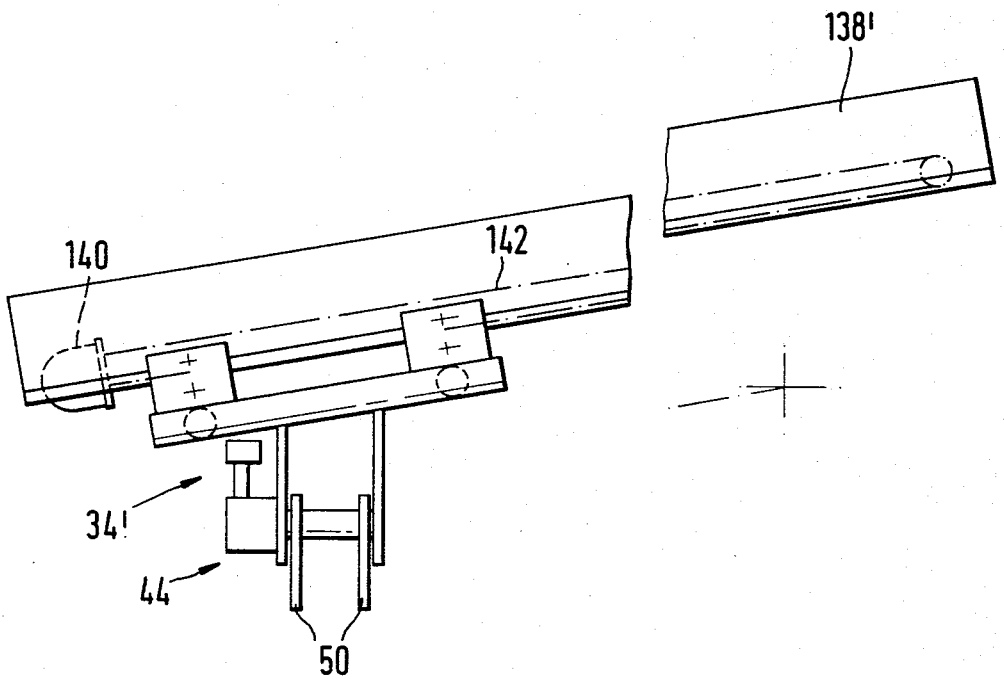
FIG. 20 is a side elevation view of an inclined arrangement of the track rails for the lance conveyor carriage in accordance with the present invention.

Referring to FIG. 20, the driving system for the lance conveyor carriage 34 of the present invention essentially consists of a combination of pneumatic motors 140 and chain pull device 142. In FIG. 20, an inclined carriage track 138 is shown which is slanted in one direction or the other as required by differences in the level between the suspensions 48 on container 30 and the suspensions 36 on the lance carriage 38, 40. In each case, the carriage 34 is designed such that the driving shaft 64 for the double rocking lever 50 is positioned horizontally.

Figure 21:
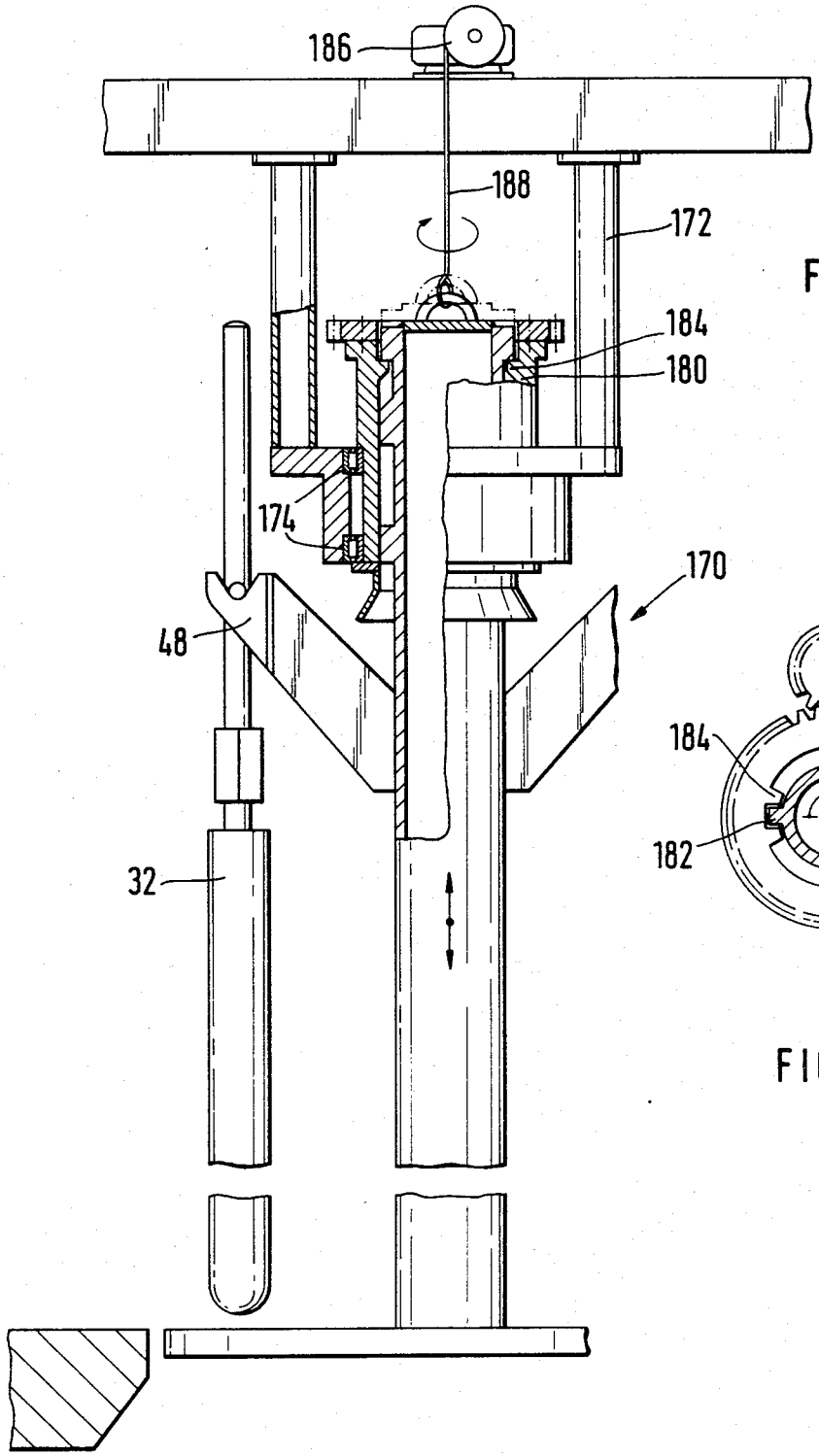
FIG. 21 is a side elevation view, partly in section, showing the construction of a suspended storage container for lances and in accordance with the present invention.
Figure 22:
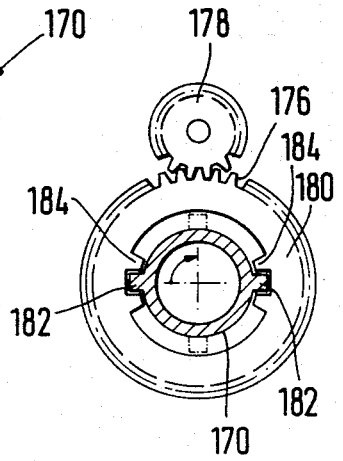
FIG. 22 is a plan view, partly in section, showing the suspension of the lance storage container shown in FIG. 21.

FIG. 21 shows another embodiment of a lance storage container in accordance with the present invention. The lance storage container 170 is suspended on a frame 172 and is rotatable in relation to the frame 172 about its longitudinal axis by means of bearings 174. The rotation of the container (for the purpose of moving the required lance 32 or an empty holder 48 into position opposite the carriage) can be affected, for example, via an electrically operated gear wheel 178 and a toothed rim (see FIG. 22). This toothed rim 176 forms the upper portion of a rotatably mounted bushing 180 in which the container is suspended. This suspension is effected by means of two mutually opposite pins 182 of the container which engage and are borne by corresponding inner suspension clips or shoulders 184 of the bushings 180. When the container 170 is positioned so that the pins 182 are on shoulders 184, the container 170 is automatically rotated about its axis with the bushing 180 as the bushing 180 is being driven by the gear wheel 178. The container 170 can also be lifted so that pins 182 are out of engagement with the shoulders 184, by means of a cable winch 186 and a cable 188. Then, after a rotation of about 90° (as shown in the dotted and dashed lines in FIG. 22) the container can be relowered, and the container can then slide downwardly out of the bushing 180 and be lowered onto a storage platform, floor, or other structure positioned thereunder. It will be understood that the process of suspending the container 170 onto the rotating bushing 180 will involve the same operations as just discussed, but only in the reverse order.

In order to release the container 170 from the rotating bushing 180, it is also possible to rotate the bushing 180 relative to container 170 instead of rotating the container 170 as described above. Under certain conditions, this may be a preferable method of releasing the container 170.

The lance storage container 170 shown in FIG. 21, offers certain advantages and features over the containers shown in the previous FIGURES. For example, container 170 will occupy less space, particularly in the vertical direction, as it now only has to be lifted out of the suspension clips or shoulders 184 whereas the container 30 had to be lifted out of a higher vertical supporting column.

Figure 23:
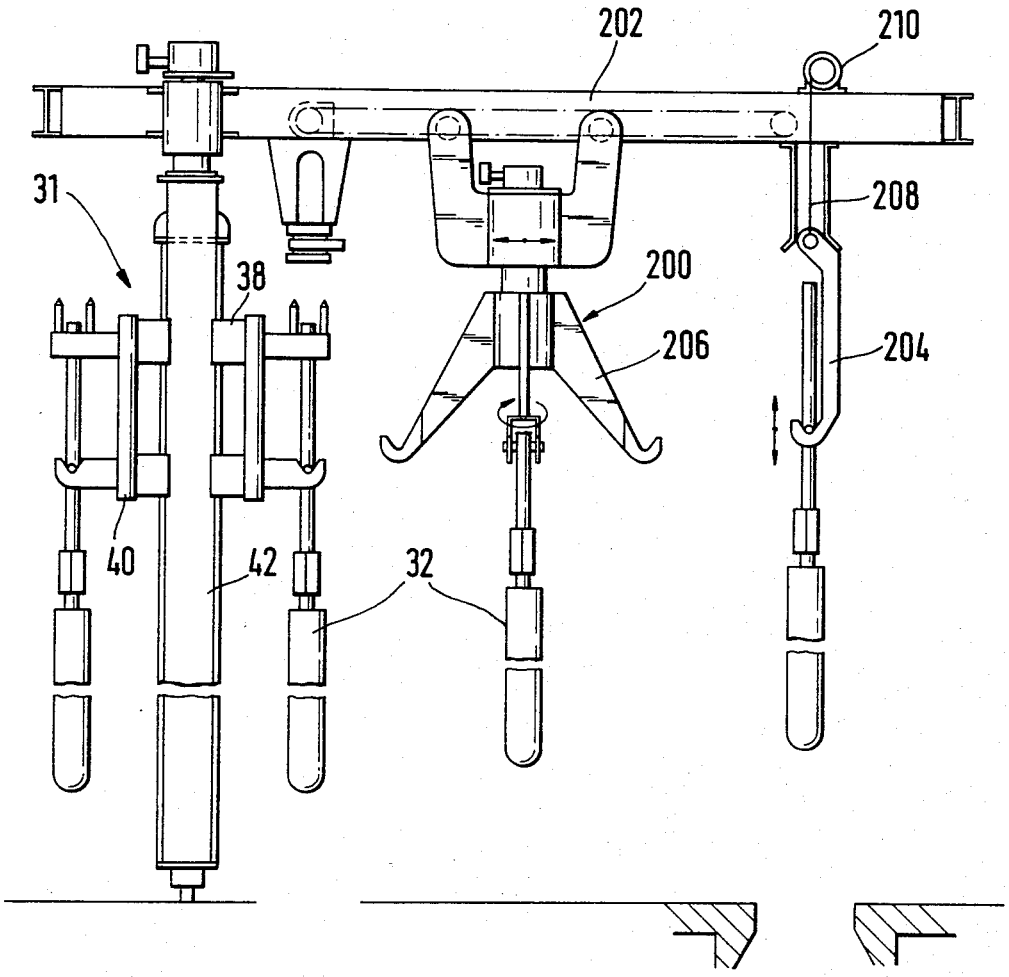
FIG. 23 is a schematic side elevation view of a second embodiment of the lance conveyor device of the present invention.
Figure 25:
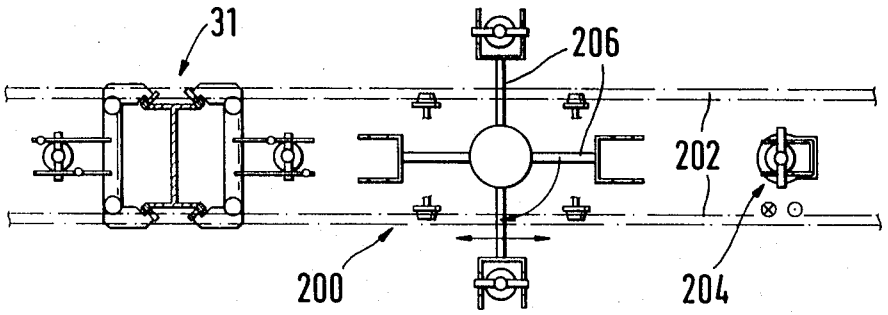
FIG. 25 is a schematic plan view of the embodiment of FIG. 23.

Referring now to FIG. 23, a schematic diagram of a simplified apparatus in accordance with the present invention is shown. In this simplified embodiment of the present invention, the lance changing apparatus 31 with the rotating double mount 42 thereon remains essentially unchanged. The changing apparatus 31 is supplied with lances via a transfer device 200 which is suspended by means of rollers on a pair of rails 202 (see also FIG. 25 which is a schematic plan view of FIG. 23), transfer device 200 being movable between the changing apparatus 31 and a hook element 204. The transfer device 200 has several hook elements 206, which may be arranged in a star-like fashion (i.e., spaced around and radiating from the center of device 200) as shown in FIG. 25. The hooks 206 act to accommodate supporting lances and are rotatable about the vertical central axis of the transfer device 200. The transfer of a lance 32 from the transfer device 200 to the lance carriage 38, or vice versa, is effected by moving the transfer device 200 to the left as shown in FIG. 23 to position the hook under the trunnion 78 of the lance and either raising or lowering the carriage 38 (before and/or after moving the transfer device 200, as may be required).

The hook 204 is suspended from a cable 208 and is either taken up or let out by means of a cable winch 210. This hook 204 will carry or convey the new or used lances between the position shown in FIG. 23 and a storage area positioned thereunder. The transfer of the lances between the transfer device 200 and the hook 204 is affected by moving the transfer device 200 towards the right as shown in FIG. 23 and either raising or lowering the hook in the directions shown by the arrows in FIG. 23 as may be required.

Figure 24:
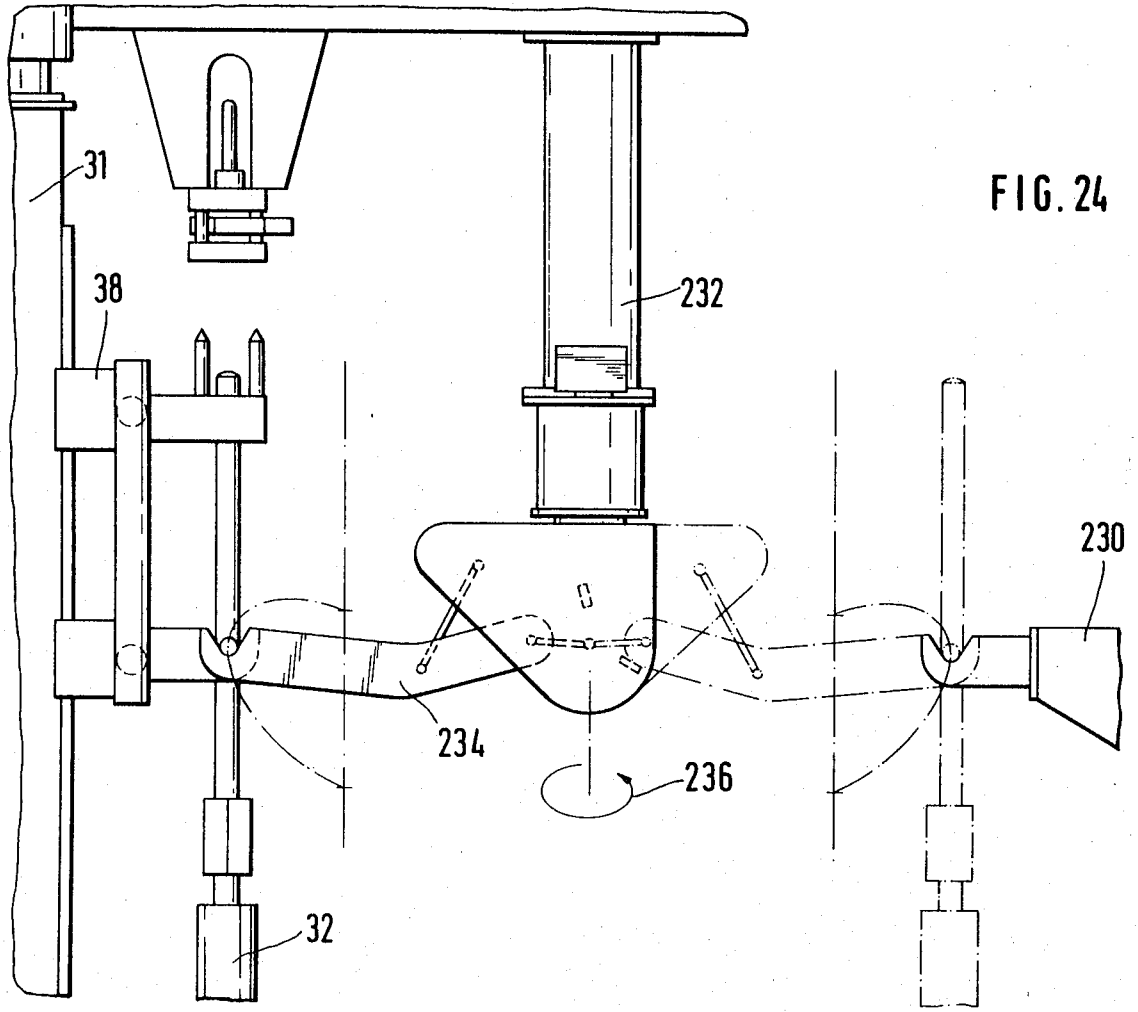
FIG. 24 is a schematic side elevation view of a third embodiment of the lance conveyor device of the present invention.
Figure 26:
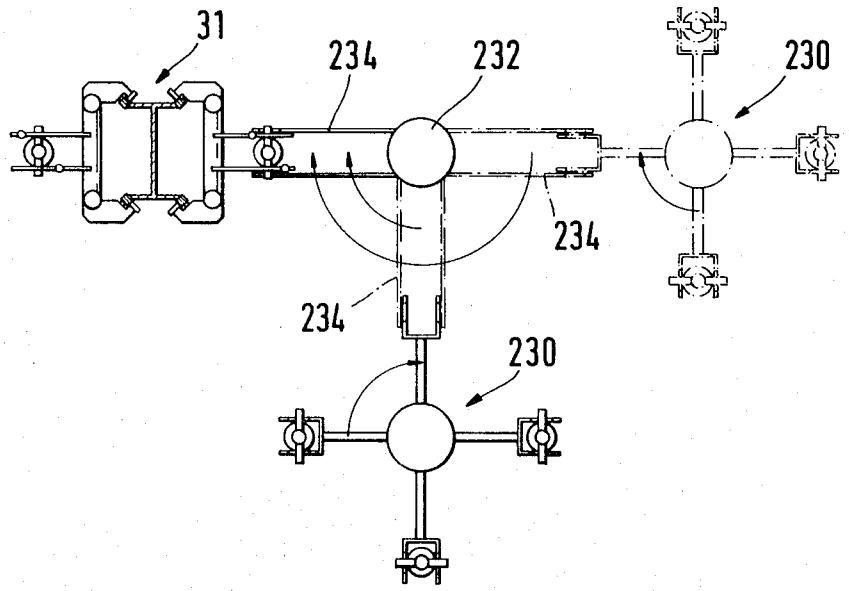
FIG. 26 is a schematic plan view of the embodiment of FIG. 24.

FIGS. 24 and 26 show an apparatus in accordance with the present invention wherein the lance storage container 230 is positioned immediately adjacent the lance changing apparatus 31. The transfer device 232 in this embodiment of the present invention may be immobile or relatively immobile in the translatory sense in comparison with the apparatus shown in FIG. 1 wherein the transfer device is easily movable over the rails. Note however, that the transfer device 232 is rotatable about its longitudinal axis, as indicated by the arrow 236. The transfer of the lances 232 is effected by means of a rocking lever 234 having the same or a similar structure and method of operation as the rocking lever 50 in the apparatus of FIG. 1. The angle of rotation of the transfer device 232 depends upon the position of the container 230. If the container 230 occupies the position shown in the full lines of FIG. 26, then the device 232 only has to be pivoted through an angle of 90° in order to transfer the lance from the lance changing apparatus 31 to the container 230 and vice versa. If, however, the container 230 is positioned as shown in the dotted and dashed lines, the transfer device 232 must be pivoted through an angle of 180°.

Referring now to FIGS. 27 and 28, a casting ladle 240 is shown having a lance 32 immersed therein. Contrary to the numerous apparatus described in the foregoing FIGURES, the lance immersion and changing apparatus 231 shown in FIGS. 27 and 28 is mounted by means of wheels on a pair of rails 244 and is capable of travelling between the two positions identified in the solid lines and broken lines in FIG. 27. Note that the apparatus 231 has the ability to move as shown in FIG. 27 without having to detach the supply pipe 102, although the connection 242 of this pipe 102 to the supply treatment materials is fixed in position. The movement is effected by the jointed connections between the individual sections of piping. FIG. 27 shows how the pipe, in the course of the immersion and extraction of the lance 32, is moved between the position 102 in full lines and the position 102' shown in the dotted and dashed lines. When the apparatus 231 of the present invention is moved from the right side to the left side, the supply pipe will rotate about the connection point 242 out of the position 102 shown in full lines and into the position 102" shown in dotted and dashed lines. It will be understood that the particular construction shown in FIGS. 27 and 28 can obviously be adapted to any of the various embodiments described in the previous FIGURES.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Apparatus for guiding and changing lances for use with a metal melt comprising:

mounting means for mounting a plurality of lances, said mounting means having a vertical axis and being capable of rotating about said vertical axis;

at least two lance carriage means mounted on and vertically movable along said mounting means, each of said lance carriage means being capable of supporting a lance;

gas supply head means for providing flow communication between a supply system and the upper part of a lance supported in at least one of said lance carriage means;

lance storage means for storing lances at a location spaced from said mounting means; and lance transfer means for transferring lances between said lance storage means and said lance carriage means.

2. The apparatus of claim 1 wherein:

said lance transfer means is movable between a first position opposed to said lance storage means for exchange of a lance between said lance transfer means and said lance storage means and a second position opposed to said lance carriage means for exchange of a lance between said lance transfer means and said lance carriage means.

3. The apparatus of claim 1 wherein said lance transfer means includes:

lance conveyor carriage means having bifurcated rocking lever means.

4. The apparatus of claim 3 wherein:

said rocking lever means has two aligned notches capable of receiving trunnions.

5. The apparatus of claim 3 wherein:

said rocking lever means is mounted on said lance conveyor carriage means at first and a second pivotal suspension points.

6. The apparatus of claim 5 wherein:

said first suspension point is located on a suspension strap, said suspension strap being pivotal about a fixed point on said conveyor carriage means.

7. The apparatus of claim 5 wherein:

said second suspension point is located at the end of a rotating arm, said rotating arm being mounted on drive shaft means for the pivotal movement of said rocking lever means.

8. The apparatus of claim 7 including:

first and second stops, said rotating arm being rotatable about said drive shaft between said stops.

9. The apparatus of claim 1 wherein:

said lance transfer means includes a column fixed in the translatory sense, said transfer means being rotatable about the vertical axis of said column.

10. The apparatus of claim 1 wherein said lance transfer means is movable between said mounting means and includes:

a plurality of hooks rotatable about the vertical axis thereof, said hooks being movable along rails.

11. The apparatus of claim 1 wherein said lance carriage means includes:

at least two parallel arms;

at least one vertical carriage pin on each arm, said pins being in a staggered arrangement relative to each other.

12. The apparatus of claim 1 including:

fixed frame means above said lance carriage means; and wherein:

said gas supply head means is secured to said fixed frame means.

13. The apparatus of claim 12 wherein said lance carriage means includes:

at least two parallel arms;

at least one vertical carriage pin on each arm, said pins being in a staggered arrangement relative to each other.

14. The apparatus of claim 13 including:

at least two fixed vertical pins on said frame, said pins being in a staggered arrangement relative to each other and being located diagonally opposite said carriage pins.

15. The apparatus of claim 14 wherein said gas supply head means includes:

at least four recesses corresponding to said lance carriage pins and said fixed pins.

16. The apparatus of claim 15 wherein:

each of said lance carriage pins and said fixed pins has a recess whereby said gas supply head means may be interlocked with a pair of either of said fixed pins or said carriage pins.

17. The apparatus of claim 16 including:

slide locking means, said locking means having at least one edge and at least one recess whereby said pin recesses interact with said edge or said recess of said locking means to effect locking or releasing between said gas supply head means and said fixed or carriage pins.

18. The apparatus of claim 17 wherein said slide locking means includes:

two parallel locking elements.

19. The apparatus of claim 16 including:

rotatable locking means, said rotatable locking means having at least one edge and at least one recess whereby said pin recesses interact with said edge or said recess of said locking means to effect locking or releasing between said gas supply head means and said fixed or carriage pins.

20. The apparatus of claim 17 including:

actuator means attached to said locking means.

21. The apparatus of claim 19 including:

actuator means attached to said rotatable locking means.

22. The apparatus of claim 1 including:

a jointed piping system comprised of a plurality of rigid pipe segments and articulated joints, said piping system being connected to said gas supply head means.

23. The apparatus of claim 1 including:

at least one drive means connected to said lance carriage means to provide vertical movement to said lance carriage means along said mount means.

24. The apparatus of claim 1 including:

four lance carriage means attached to said mount means.

25. The apparatus of claim 3 including:

drive means connected to said lance conveyor carriage means.

26. The apparatus of claim 7 wherein said lance transfer means further includes:

shaft drive means for said drive shaft, said shaft drive means having at least one motor for selectively driving said shaft drive means.

27. The apparatus of claim 26 including:

a pair of motors engaging said shaft drive means at the two end positions of said shaft.

28. The apparatus of claim 7 wherein said drive shaft means further includes:

spline shaft means, said spline shaft means being associated with at least one drive motor for said drive shaft means.

29. The apparatus of claim 1 including:

drive means for said mounting means.

30. The apparatus of claim 29 wherein said drive means for said mounting means includes:

first and second parallel cylinders having, respectively, first and second piston rods, said cylinders being interconnected by yoke means;

lever means;

said first piston rod being pivotally connected to a first end of said lever means, said second end of said lever means being pivotally connected to said yoke means; and said second piston rod being pivotally connected to a fixed frame.

31. The apparatus of claim 1 wherein:

said lance storage means is a turret-type container capable of holding a plurality of lances.

32. The apparatus of claim 31 wherein:

said container is mounted on the floor.

33. The apparatus of claim 31 wherein:

said container is suspended above the floor by suspension means.

34. The apparatus of claim 33 wherein said suspension means includes:

a plurality of support lugs on said container; and a rotatable bushing having support shoulders for engaging said lugs.

35. The apparatus of claim 1 wherein said lance storage means includes:

at least one hook suspended from a cable having a cable winch associated therewith.

36. The apparatus of claim 10 wherein said lance storage means includes:

at least one hook suspended from a cable having a cable winch associated therewith.

37. The apparatus of claim 1 wherein:

said lance transfer means is positioned between said storage means and said mount means;

said lance transfer means being rotatable about its longitudinal axis to effect transfer of lances between said storage means and said mounting means.

* * * * *